US011247812B2

(12) United States Patent
McMurphy

(10) Patent No.: US 11,247,812 B2
(45) Date of Patent: Feb. 15, 2022

(54) APPARATUS, SYSTEM, AND METHOD FOR SEPARATING STORAGE CONTAINERS

(71) Applicant: John McMurphy, Otis, CO (US)

(72) Inventor: John McMurphy, Otis, CO (US)

( * ) Notice: Subject to any disclaimer, the term of this patent is extended or adjusted under 35 U.S.C. 154(b) by 257 days.

(21) Appl. No.: 16/412,800

(22) Filed: May 15, 2019

(65) Prior Publication Data

US 2019/0352049 A1 Nov. 21, 2019

Related U.S. Application Data

(60) Provisional application No. 62/671,590, filed on May 15, 2018.

(51) Int. Cl.
*B65D 21/02* (2006.01)

(52) U.S. Cl.
CPC ..... *B65D 21/0233* (2013.01)

(58) Field of Classification Search
CPC ..... B65D 21/02; B65D 21/0233; B65D 25/32
USPC ..... 220/23.83, 729; 206/514, 515, 516, 519, 206/821
See application file for complete search history.

(56) References Cited

U.S. PATENT DOCUMENTS 1,468,748 A * 9/1923 Schuman ..... B65D 57/00 206/516
2018/0134448 A1* 5/2018 Andreasen ..... B65D 21/0233

* cited by examiner

*Primary Examiner* — Don M Anderson
*Assistant Examiner* — Elizabeth J Volz
(74) *Attorney, Agent, or Firm* — Sheridan Ross PC

(57) ABSTRACT

Separation members are described herein that prevent two stacked storage containers from sticking to each other. In some embodiments, the separation member can have a slot in a first body portion configured to receive a handle of one storage container and have a second body portion that is configured to rest on a top edge of a another storage container. Thus, the separation member is readily positioned between two storage containers to limit the distance that the top storage container can descend into the bottom storage container to prevent a detrimental suction forming between the two storage containers. The separation member can be integrated with a storage container during the manufacturing process or can retrofit existing storage containers.

20 Claims, 3 Drawing Sheets

APPARATUS, SYSTEM, AND METHOD FOR SEPARATING STORAGE CONTAINERS

CROSS-REFERENCE TO RELATED APPLICATIONS

This application claims priority under 35 U.S.C. § 119(e) to U.S. Provisional Patent Application Ser. No. 62/671,590 filed May 15, 2018, which is incorporated herein in its entirety by reference.

FIELD OF THE INVENTION

Embodiments of the present disclosure are related to an apparatus that prevents storages containers from sticking to one another.

BACKGROUND

Storage containers, such as five gallon buckets, are used in a variety of applications. While not in use, storage containers can be nested together or stacked to save space. Generally, the bottom end of one storage container is set into the storage volume of another, identical-sized storage container. Since the side and bottom wall thicknesses are substantially constant, the bottom end of one container matches the storage volume of another container. As a result, a large surface area of one container contacts a large surface area of another container, and air is evacuated from between the stacked containers. The stacked containers can become lodged together and extremely difficult to separate. Further, the addition of a liquid and associated surface tension can make two containers nearly impossible to separate. The forces required to separate two stacked containers can distort one or both of the containers to prevent future stacking or even render a container inoperative for storing materials.

SUMMARY

The above shortcomings and other needs are addressed by the various embodiments and configurations of the present disclosure. It is an objective of the present disclosure to provide an apparatus member or separation member between two stacked storage containers to prevent sticking between stacked containers. The separation member reduces the contact area between one container and the storage volume of another container. The separation member also permits air and fluid flow between stacked containers to prevent the detrimental suction between stacked containers.

One aspect of embodiments of the present disclosure is to integrally include a separation member into a storage container when the storage container or bucket is manufactured. The separation member can be a rib which extends from a side wall of the storage container from an inner and/or outer surface of the side wall. In some embodiments, the storage container has only one separation member. In other embodiments, the storage container has multiple separation members. In further embodiments, the separation members are evenly spaced about an inner and/or outer surface of the storage container. When the storage container is a substantially cylindrical shape, the separation members or ribs can be evenly spaced about a central axis of the storage container.

One or more of the separation members can extend from a bottom wall of the storage container to a top edge of the storage container. Alternatively, one or more of the separation member can extend from one, both, or neither of the bottom wall and top edge of the storage container. Further still, embodiments of the present disclosure are not limited to separation members that extend from a side wall. In other embodiments, for example, one or more separation members can extend from an inner and/or outer surface of the bottom wall.

One aspect of embodiments of the present disclosure is to provide a separation member that can be retrofitted to existing storage containers or buckets. A separation member can selectively connect to a top edge, a bottom wall, and/or a side wall of a storage container to maintain a separation distance between two stacked storage containers. The separation member can have a body that provides the separation functionality and an extension that protrudes from the body at an angle to set the separation member on the top edge of a storage container. It will be appreciated that other extensions can provide the selective connection to a storage container. For example, the separation member can have a recess that deflects to receive the top edge of a storage container to selectively connect the separation member to the storage container.

One aspect of embodiments of the present disclosure is to provide a separation member that can accommodate a variety of storage container sizes and shapes. Storage containers made by different companies can have different sizes and/or shapes even though the storage containers may both be, for example, a "five gallon bucket." Therefore, in some embodiments of the disclosure, a separation member is provided with a first body portion extending along a first axis and a second body portion extending along a second axis. The second body portion is generally oriented horizontally during use and provides an increased area to engage a top edge of a lower storage container. The second body portion provides flexibility to the separation member to accommodate storage containers with different sizes and/or shapes. As discussed in further detail below, the size of the second body portion and the relative size of the second body portion compared to other components of the separation member may be critical to the function of the separation member.

One aspect of embodiments of the present disclosure is to provide a separation member with a slot extending into a first body portion where the slot receives a handle of a storage container. Typically, a storage container has a handle with two ends, and each end is rotatably connected to the storage container so that the handle can rotate about an axis. In some embodiments, a portion of the handle at or near the ends is substantially parallel to the axis of rotation to provide clearance between the storage container and the rotating handle. The slot in the separation member can be configured to receive this clearance portion of the handle. As discussed in further detail below, the size of the slot and the relative size of the slot compared to other components of the separation member may be critical to the function of the separation member.

One particular embodiment of the present disclosure is a separation member adapted to prevent a first storage container from sticking to a second storage container, comprising a first body portion extending along a first axis from a first end and a second end, the first body portion having a first thickness along a second axis that is substantially perpendicular to the first axis; a second body portion extending from the first end of the first body portion along the second axis, wherein second body portion has a second thickness along the second axis, and the second thickness is equal to or greater than the first thickness; and a slot extending into the second end of the first body portion and oriented along the first axis.

In some embodiments, a ratio between the first thickness and the second thickness is between approximately 1:5 and 1:1. In various embodiments, the first thickness is between approximately ⅛" and ¼", and the second thickness is approximately ½". In some embodiments, the slot extends into the first body portion by a slot length, and the first body portion has a body length, wherein a ratio between the slot length and the body length is between approximately 1:8 and less than 1:1. In various embodiments, the slot length is approximately 1", and the body length is approximately 2¾". In some embodiments, the slot has a slot width, and the first body portion has a body width, wherein a ratio between the slot width and the body with is between approximately 1:16 and less than 1:1. In various embodiments, the slot width is between approximately ⅛" and ¼", and the body width is approximately ¾". In some embodiments, the separation member further comprises a second slot in the first body portion.

Another particular embodiment of the present disclosure is a system for preventing storage containers from sticking together, comprising a first storage container having a handle that rotates about an axis; a second storage container having a top edge that at least partially defines an opening into a volume of the second storage container; and a separation member having a first body portion extending along a first axis and a second body portion extending along a second axis, wherein the first and second axes are substantially perpendicular and a slot extends into the first body portion, wherein the slot receives the handle of the first storage container and the second body portion contacts the top edge of the second storage container to prevent the storage containers from sticking together.

In some embodiments, a clearance portion of the handle extends substantially parallel to the axis, and the slot receives the clearance portion of the handle. In various embodiments, the clearance portion has a clearance length, and the first body portion has a first thickness, wherein the clearance length is equal to or greater than the first thickness. In some embodiments, a distal end of the second body portion contacts an exterior surface of the first storage container. In various embodiments, the first storage container has an exterior surface, and the second storage container has an interior surface, and wherein the exterior surface is offset from the interior surface by a predetermined distance. In some embodiments, the first storage container is a 5 gallon bucket.

In various embodiments, the first body portion has a first thickness along the second axis, and the second body portion extends along the second axis by a second thickness, wherein a ratio between the first thickness and the second thickness is between approximately 1:5 and 1:1. In some embodiments, the slot extends into the first body portion by a slot length, and the first body portion has a body length, wherein a ratio between the slot length and the body length is between approximately 1:8 and less than 1:1. In various embodiments, the slot has a slot width, and the first body portion has a body width, wherein a ratio between the slot width and the body with is between approximately 1:16 and less than 1:1.

In some embodiments, the exterior surface of the first storage container tapers at a first angle relative to the first axis, and the interior surface of the second storage container tapers at a second angle relative to the first axis, wherein the first angle is substantially the same as the second angle. In various embodiments, the separation member is integrated with the first storage container.

Yet another particular embodiment of the present disclosure is a separation member adapted for use with a storage container, comprising a first body portion extending along a first axis from a first end and a second end, the first body portion having a first thickness along a second axis; a second body portion extending from the first end of the first body portion along the second axis, wherein second body portion has a second thickness along the second axis, and the second thickness is equal to or greater than the first thickness, wherein a ratio between the first thickness and the second thickness is between approximately 1:5 and 1:1; and a slot extending into the second end of the first body portion by a slot length, and the slot is oriented along the first axis, wherein the slot length is approximately 1" and a slot width is between approximately ⅛" and ¼".

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary, brief description of the drawings, detailed description, abstract, and claims themselves.

BRIEF DESCRIPTION OF THE DRAWINGS

The accompanying drawings, which are incorporated in and constitute a part of the specification, illustrate embodiments of the disclosure and together with the Summary of the Invention given above and the Detailed Description of the drawings given below, serve to explain the principles of these embodiments. In certain instances, details that are not necessary for an understanding of the disclosure or that render other details difficult to perceive may have been omitted. It should be understood, of course, that the disclosure is not necessarily limited to the particular embodiments illustrated herein. Additionally, it should be understood that the drawings are not necessarily to scale.

Figure 1:
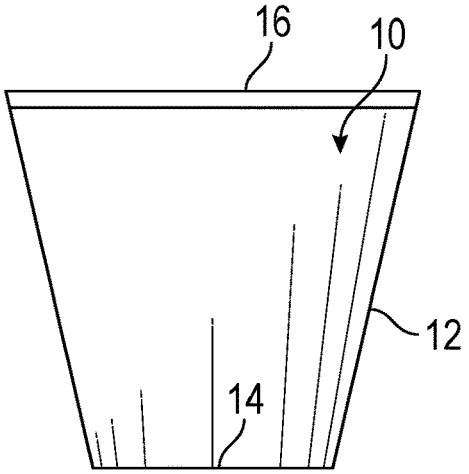
FIG. 1 is a side cross-sectional view of a storage container in accordance with one embodiment of the present disclosure.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Storage Container |
| 12 | Side Wall |
| 14 | Bottom Wall |
| 16 | Top Edge |
| 18 | Separation Member |
| 20 | Body |
| 22 | Extension |
| 24 | First Storage Container |
| 26 | First Handle |
| 28 | First Rotation Axis |
| 30 | Second Storage Container |
| 32 | Second Handle |
| 34 | Second Rotation Axis |
| 36 | Separation Member |
| 38 | Offset |

-continued

| Number | Component |
|---|---|
| 40 | Slot |
| 42 | Bottom Edge |
| 44 | Top Edge |
| 46 | First Body Portion |
| 48 | First Axis |
| 50 | First End |
| 52 | Second End |
| 54 | Slot Length |
| 56 | Body Length |
| 58 | Slot Width |
| 60 | Body Width |
| 62 | Second Slot |
| 64 | Second Body Portion |
| 66 | Second Axis |
| 68 | First Body Thickness |
| 70 | Second Body Thickness |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present disclosure are described herein and as depicted in the drawings. It is expressly understood that although the figures depict storage containers and separation members, and methods and systems for using the same, the present disclosure is not limited to these embodiments.

Now referring to FIG. 1, a cross-sectional side view of a storage container 10 is provided. The storage container 10 has a side wall 12 that extends upward from a bottom wall 14. The side wall 12 terminates at a top edge 16, which defines an opening that provides access to a storage volume defined by the side and bottom walls 12, 14. As depicted, the side wall 12 tapers outward as the side wall 12 extends to the top edge 16, and the side and bottom walls 12, 14 have a substantially constant wall thickness. Therefore, when two of these storage containers 10 are stacked within each other, air is evacuated between the containers 10 and a large area of one container 10 contacts a large area of the other container 10, which creates a suction between the containers 10. While embodiments of the present disclosure are described with respect to a 5-gallon bucket, it will be appreciated that the storage container 10 can be any type or container, or even non-container, that can be stacked with one another.

Figure 2:
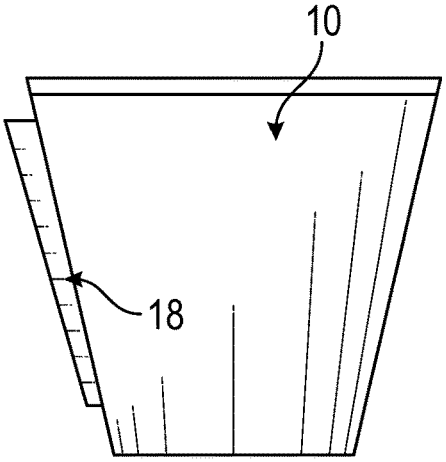
FIG. 2 is a side cross-sectional view of a storage container with an integrated separation member in accordance with one embodiment of the present disclosure.

Now referring to FIG. 2, a cross-sectional side view of a storage container 10 with a separation member 18 is provided. In this embodiment, the separation member 18 is integrated with the side wall of the storage container. Most 5-gallon buckets are injection molded plastic, and therefore, a modification to the mold can allow for additional plastic material to form a separation member 18 or integral rib. In other embodiments, the separation member 18 is made from a different material than the storage container 10. Thus, the separation member 18 is positioned in the mold and the storage container 10 is formed around the separation member 18 to encase and connect to at least a portion of the separation member 18.

As depicted in FIG. 2, the separation member has a particular shape. The storage container 10 has a side wall that tapers upward at a predetermined angle formed with the bottom wall. In this embodiment, the outer surface of the separation member 18 tapers at a different predetermined angle formed with the bottom wall. This reduces the contact area between the container 10 and another container 10 and also prevents a suction force between two containers 10. It will be appreciated that in some embodiments, the outer surface of the separation member 18 tapers at the same angle as the side wall, which increases the contact area between two containers 10 to more evenly distribute weight and/or forces, but still dramatically reduces the contact area between two containers 10 without any separation member 18. Further, while the separation member 18 in FIG. 2 extends from an outer surface of the side wall, it will be appreciated that in some embodiments the separation member 18 extends from an inner surface of the side wall.

Any number and configuration of separation members 18 is also contemplated in accordance with embodiments of the present disclosure. For instance, a storage container 10 can have a plurality of separation members 18 positioned on the inner surface and/or the outer surface of the side wall and/or bottom wall. These separation members 18 can be evenly spaced about a central axis of the storage container 10. Further, the separation member 18 can have various dimensions. In some embodiments, the thickness of the separation member 18 at a top end is between approximately 1/16" and 1". In preferred embodiments, the thickness of the separation member 18 at the top end is approximately ¼". In various embodiments, the length of the separation member 18 from the top end to a bottom end is between approximately 2" and 14". In preferred embodiments, the length of the separation member 18 from the top end to the bottom end is approximately 10". In some embodiments, the thickness of the separation member 18 at the bottom end is between approximately 1/32" and ½". In preferred embodiments, the thickness of the separation member 18 at the bottom end is approximately ⅛".

Figure 3:
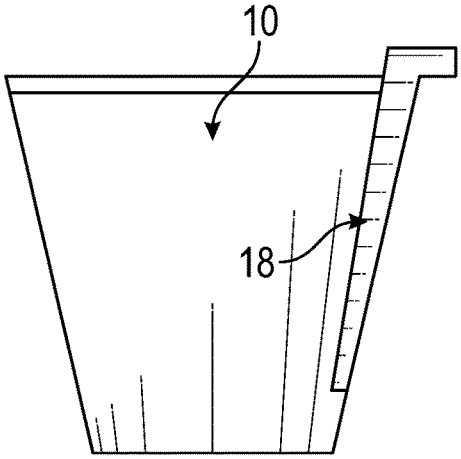
FIG. 3 is a side cross-sectional view of a storage container with a selectively-connectable separation member in accordance with one embodiment of the present disclosure.
Figure 4:
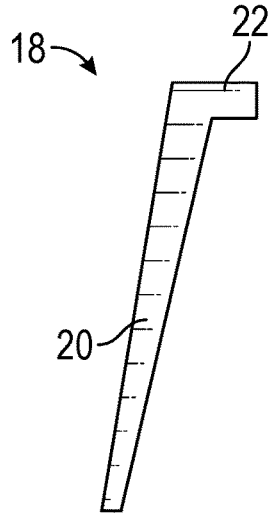
FIG. 4 is a side view of a selectively-connectable separation member in accordance with one embodiment of the present disclosure.

Now referring to FIGS. 3 and 4, a cross-sectional side view of a storage container 10 with a separation member 18 selectively connected to the storage container 10 and a side view of a separation member 18 are provided, respectively. In this embodiment, the separation member 18 is manufactured separately from the storage container 10. The separation member 18 has a body 20 and an extension 22 is oriented at an angle with respect to a longitudinal axis and/or outer surface of the body 20. During operation, a user can set the separation member 18 on the top edge of the container 10 to provide the functionality described herein, including reducing the contact area between stacked containers 10. It will be further appreciated that the separation member 18 can have dimensions such as those described herein. In addition, it will be appreciated that the separation member 18 can have other features to selectively connect the separation member 18 to the container 10. For instance, the extension 22 can have an aperture or recess on a bottom surface that is configured to receive the top edge of the container 10. The aperture or recess can temporarily deflect to a larger dimension as the aperture or recess receives the top edge to provide a selectively connection. While the separation member 18 in FIGS. 3 and 4 is configured to be disposed on an inner surface of the side wall of a container 10, it will be appreciated that the separation member 18 can be disposed on an outer surface of the side wall of the container 10.

Figure 5A:
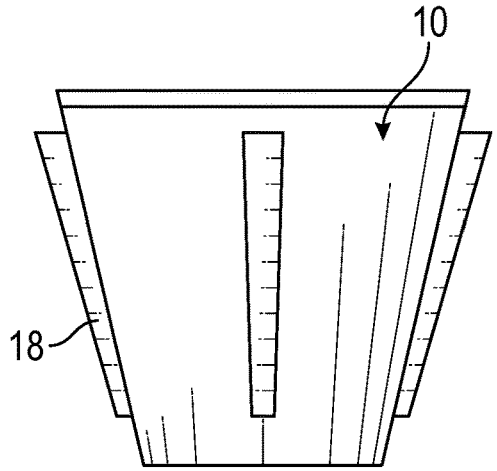
FIG. 5A is a side view of a storage container with multiple, integrated separation members in accordance with one embodiment of the present disclosure.
Figure 5B:
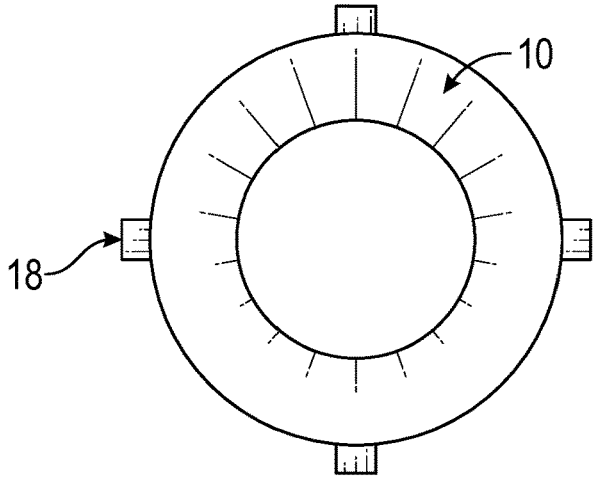
FIG. 5B is a top plan view of the storage container in FIG. 5A in accordance with one embodiment of the present disclosure.

Now referring to FIGS. 5A and 5B, a side elevation view and a top plan view of a storage container 10 are provided, respectively. In this embodiment, the storage container 10 comprises multiple separation members 18 arrayed on an outer surface of the storage container 10. The separation members 18 are spaced equally about a center axis of the storage container 10. It will be appreciated that while the depicted separation members 18 taper from a larger thickness at an upper end to a smaller thickness at a lower end, embodiments of the present disclosure can include one or more separation members that have equal thicknesses at the upper and lower ends and along the length of the separation member. In addition, the storage container 10 can have a side wall that is substantially vertical rather than the tapered side wall as shown in the figures.

Further, while the figures depict the separation member as a rib or an elongated structure, it will be appreciated that the separation member can include a variety of structures. For example, in one embodiment, the separation member is a protrusion from one or both of an inner surface and an outer surface of the storage container. The protrusion can take the form of a dome or a portion of a sphere. In this embodiment, the separation member reduces the contact area between stacked storage containers. Further still, multiple protrusions can be arrayed about one or both of the inner and outer surfaces to reduce contact area but also to provide adequate support between stacked storage containers.

Figure 6A:
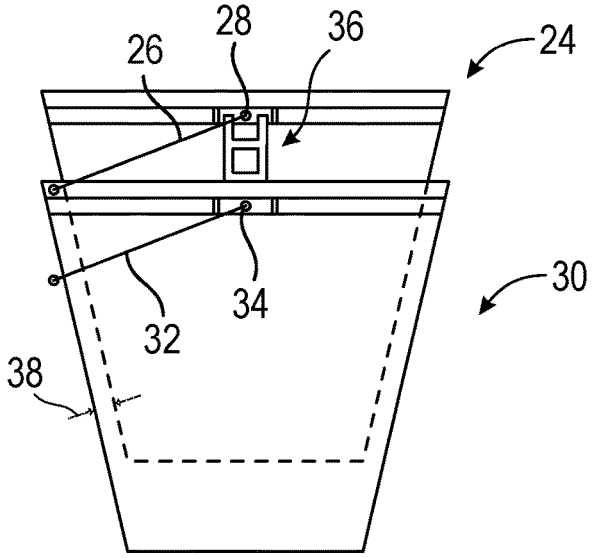
FIG. 6A is a side view of storage containers with a separation member in accordance with one embodiment of the present disclosure.

Now referring to FIGS. 6A-6D, various views of a further embodiment of a separation member 36 are provided. FIG. 6A is a side view of a first storage container 24, a second storage container 30, and a separation member 36. The first storage container 24 has a first handle 26 that rotates about a first axis 28, and similarly, the second storage container 30 has a second handle 32 that rotates about a second axis 34. A portion of the first handle 26 can extend away from the first storage container 24 at an angle that is substantially parallel to the first axis 28 to provide clearance for the first handle 26 as the first handle 26 rotates. It will be appreciated that the terms "approximately" and/or "substantially" can indicate a 0% to 5% relative difference. It will be further appreciated that the terms "approximately" and/or "substantially" can indicate a less than 2% relative difference. Similarly, the second handle 32 can have a similar clearance portion. In some embodiments, each end of each handle 28, 32 has such a clearance portion.

As shown in FIG. 6A and as described above, the storage containers 24, 30 are shaped to nest within each other to stack multiple storage containers. The exterior surface of the first storage container 24 can approach the interior surface of the second storage container 30. The separation member 36 prevents these surfaces from contacting each other and provides an offset 38 between these surfaces to prevent the storage containers 24, 30 from sticking together. It will be appreciated that these surfaces can taper from an open end to a closed end of the containers 24, 30 in some embodiments. In various embodiments, each container 24, 30 is a five gallon bucket, but it will be appreciated that this disclosure encompasses any type of containers 24, 30 that can benefit from a separation member 36 that prevents the containers 24, 30 from sticking together.

Figure 6B:
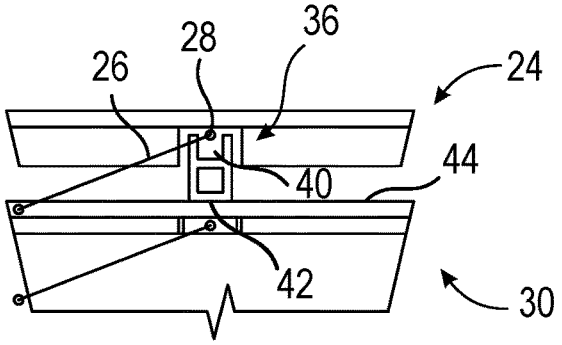
FIG. 6B is a side view of storage containers with a separation member in accordance with one embodiment of the present disclosure.

Referring to FIG. 6B, a separation member 36 is provided that allows the storage containers 24, 30 to stack but also prevents the storage containers 24, 30 from sticking together. A slot 40 extends into the separation member 36 at a top end of the separation member 36. The slot 40 is configured to receive the clearance portion of the first handle 26 in some embodiments. The first storage container 24 descends into the second storage container 30 until the first handle 26 is positioned at the bottom of the slot 40, and a bottom edge 42 of the separation member 36 is positioned on a top edge 44 of the second storage container 30. At this position, the separation member 36 prevents the first storage container 24 from being completely nested within, and sticking to, the second storage container 30.

Figure 6C:
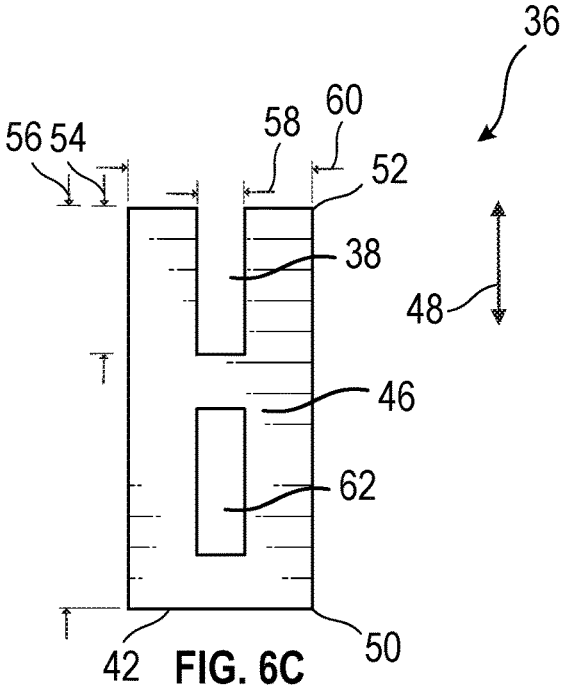
FIG. 6C is a side view of a separation member in accordance with one embodiment of the present disclosure.
Figure 6D:
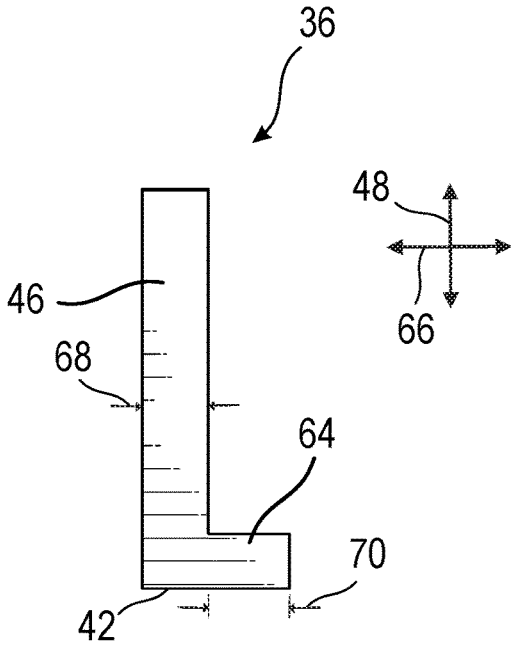
FIG. 6D is an elevation view of the separation member in FIG. 6C in accordance with one embodiment of the present disclosure.

Referring to FIGS. 6C and 6D, various aspects of the separation member 36 are shown that allow the separation member 36 to prevent storage containers from sticking together. The dimensions and ratios discussed herein can be critical for the separation member to prevent storage containers from sticking together. The separation member 36 generally comprises a first body portion 46 that extends along a first axis 48 from a first end 50 to a second end 52. As shown, the slot 40 extends into the second end 52 of the first body portion 46 along the first axis 48. The slot 40 has a geometry that allows the separation member 36 to securely receive a portion of a handle. The slot 40 has a slot length 54 along the first axis 48 that is between approximately ½" to 1½" in some embodiments. In various embodiments, the slot length 54 is approximately 1". Similarly, the separation member 36 can have a body length 56, which in some embodiments is between approximately 1½" to 4". In various embodiments, the body length 56 is approximately 2¾". The length of the slot 40 can also be expressed in terms of a ratio relative to the body length 56. Thus, the ratio between the slot length 54 and the body length 56 can be between approximately 1:8 and less than 1:1 in various embodiments. In some embodiments, this ratio is approximately 1:2.75.

The slot 40 also has a slot width 58 that is between approximately 1/16" to ¾" in some embodiments. In various embodiments, the slot width 58 is between approximately ⅛" and ¼". In yet further embodiments, the slot width 58 is approximately 3/16". Similarly, the separation member 36 has a body width 60 that is between ½" and 1" in some embodiments. In various embodiments, the body width 60 is approximately ¾". Like the length of the slot 40, the width of the slot 40 can be expressed as a ratio relative to the body width 60. Thus, the ratio between the slot width 58 and the body width 60 is between approximately 1:16 and less than 1:1. In various embodiments, this ratio is approximately 1:4.

The first body portion 46 may have a second slot 62 in various embodiments. It will be appreciated that in some embodiments, there is no additional slot 62, and the first body portion 46 is continuous with the exception of the slot 40.

Now referring to FIG. 6D, a further view of the separation member 36 is provided. A second body portion 64 extends away from the first body portion 46 along a second axis 66, which is substantially perpendicular to the first axis 48. The second body portion 64 at least partially defines the bottom edge 42 of the separation member 36 that contacts the top edge of a container to prevent two containers from sticking together. The second body portion 64 increases the area of the separation member 36 that faces the lower container to accommodate variability in container sizes and shapes without disrupting the stacking of containers. For instance five gallon buckets may contain the same amount of contents but have different shapes. The second body portion 64 provides flexibility and allows the separation member 36 to prevent sticking across a wide range of containers. A distal end of the second body portion 64 can contact the exterior surface of the upper container to brace the separation member 36 against the upper container as the upper container descends onto the lower container.

The first body portion 46 has a first body thickness 68 in FIG. 6D. The first body thickness 68 can be between approximately ⅛" and ¼" in some embodiments. In various embodiments, the first body thickness 68 is approximately 3/16". The second body portion 64 extends away from the first body portion 46 by a second body thickness 70 that is between approximately ¼" and ⅝" in some embodiments. In various embodiments, the second body thickness 70 is approximately ½". The second body thickness 70 can be expressed as a ratio relative to the first body thickness 68, and this ratio is between approximately 1:5 and 1:1 in some embodiments. In various embodiments, this ratio is approximately 3:8.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. A separation member adapted to prevent a first storage container from sticking to a second storage container, comprising:

a first body portion extending along a first axis from a first end and a second end, said first body portion having a first thickness along a second axis that is substantially perpendicular to said first axis;

a second body portion extending from said first end of said first body portion along said second axis, wherein second body portion has a second thickness along said second axis, and said second thickness is equal to or greater than said first thickness;

a first slot extending into said second end of said first body portion and oriented along said first axis; and a second slot extending into said first end of said first body portion and oriented along said first axis.

2. The separation member of claim 1, wherein a ratio between said first thickness and said second thickness is between approximately 1:5 and 1:1.

3. The separation member of claim 2, wherein said first thickness is between approximately ⅛" and ¼", and said second thickness is approximately ½".

4. The separation member of claim 1, wherein said first slot extends into said first body portion by a slot length, and said first body portion has a body length, wherein a ratio between said slot length and said body length is between approximately 1:8 and less than 1:1.

5. The separation member of claim 4, wherein said slot length is approximately 1", and said body length is approximately 2¾".

6. The separation member of claim 1, wherein said first slot has a slot width, and said first body portion has a body width, wherein a ratio between said slot width and said body with is between approximately 1:16 and less than 1:1.

7. The separation member of claim 6, wherein said slot width is between approximately ⅛" and ¼", and said body width is approximately ¾".

8. The separation member of claim 1, wherein the first body portion and the second body portion are linear.

9. A system for preventing storage containers from sticking together, comprising:

a first storage container having a handle that rotates about an axis;

a second storage container having a top edge that at least partially defines an opening into a volume of said second storage container; and a separation member having a first body portion extending along a first axis and a second body portion extending along a second axis, wherein said first and second axes are substantially perpendicular and a slot extends into said first body portion, wherein said slot receives said handle of said first storage container and said second body portion contacts said top edge of said second storage container to prevent said storage containers from sticking together, and wherein the first and second body portions are linear.

10. The system of claim 9, wherein a clearance portion of said handle extends substantially parallel to said axis, and said slot receives said clearance portion of said handle.

11. The system of claim 10, wherein said clearance portion has a clearance length, and said first body portion has a first thickness, wherein said clearance length is equal to or greater than said first thickness.

12. The system of claim 9, wherein a distal end of said second body portion contacts an exterior surface of said first storage container.

13. The system of claim 9, wherein said first storage container has an exterior surface, and said second storage container has an interior surface, and wherein said exterior surface is offset from said interior surface by a predetermined distance.

14. The system of claim 9, wherein said first storage container is a 5 gallon bucket.

15. The system of claim 9, wherein said first body portion has a first thickness along said second axis, and said second body portion extends along said second axis by a second thickness, wherein a ratio between said first thickness and said second thickness is between approximately 1:5 and 1:1.

16. The system of claim 9, wherein said slot extends into said first body portion by a slot length, and said first body portion has a body length, wherein a ratio between said slot length and said body length is between approximately 1:8 and less than 1:1.

17. The system of claim 9, wherein said slot has a slot width, and said first body portion has a body width, wherein a ratio between said slot width and said body with is between approximately 1:16 and less than 1:1.

18. The system of claim 9, wherein said exterior surface of said first storage container tapers at a first angle relative to said first axis, and said interior surface of said second storage container tapers at a second angle relative to said first axis, wherein said first angle is substantially the same as said second angle.

19. The system of claim 9, wherein said separation member is integrally connected with said first storage container.

20. A separation member adapted for use with a storage container, comprising:

a first body portion extending along a first axis from a first end and a second end, said first body portion having a first thickness along a second axis;

a second body portion extending from said first end of said first body portion along said second axis, wherein second body portion has a second thickness along said second axis, and said second thickness is equal to or greater than said first thickness, wherein a ratio between said first thickness and said second thickness is between approximately 1:5 and 1:1 and a width of the first body portion is equal to a width of the second body portion; and a slot extending into said second end of said first body portion by a slot length, and said slot is oriented along said first axis, wherein said slot length is approximately 1" and a slot width is between approximately ⅛" and ¼".

* * * * *